US005501321A

United States Patent [19]

Liu

[11] Patent Number: 5,501,321

[45] Date of Patent: Mar. 26, 1996

[54] EYEGLASSES CASE

[76] Inventor: Chin-Fen Liu, P.O. Box 82-144, Taipei, Taiwan

[21] Appl. No.: 403,939

[22] Filed: Mar. 14, 1995

[51] Int. Cl.[6] ..... A45C 11/04

[52] U.S. Cl. ..... 206/5; 206/6; 351/155

[58] Field of Search ..... 206/5, 6; 351/47, 351/155, 158; 248/902

[56] References Cited

U.S. PATENT DOCUMENTS

| | | | |
|---|---|---|---|
| 3,323,638 | 6/1967 | Dishart | 206/5 |
| 3,604,013 | 9/1971 | Hammond | 351/47 |
| 4,000,810 | 1/1977 | Leblanc | 206/5 |
| 5,376,977 | 12/1994 | Liu | 351/155 |
| 5,379,463 | 1/1995 | Schleger | 351/155 |

*Primary Examiner*—David T. Fidei
*Attorney, Agent, or Firm*—Alfred Lei

[57] ABSTRACT

An eyeglasses case including a cover made of transparent colored material and having two lugs each at one side thereof, a movable frame having two ears each at one end thereof and being rotatably connected between the two lugs of the cover, the movable frame having a bottom formed with a recess and having a top formed with two slits, and a container having two side edges adapted to engage with the lugs of the cover and two upper edges adapted to engage with the slits of the movable frame, whereby the cover can be disengaged from the container so as to be used as a sunshield for a pair of eyeglasses as desired.

2 Claims, 3 Drawing Sheets

EYEGLASSES CASE

BACKGROUND OF THE INVENTION

It has been found that the conventional eyeglasses case is simply a container for receiving a pair of eyeglasses. Further, the conventional sunshield for a pair of eyeglasses is an additional member designed for mounting on the eyeglasses and has to be stowed in another container when not in use thereby causing much inconvenience in use.

Therefore, it is an object of the present invention to provide an eyeglasses case which can obviate and mitigate the above-mentioned drawbacks.

SUMMARY OF THE INVENTION

This invention relates to an eyeglasses case.

It is the primary object of the present invention to provide an eyeglasses case having a cover which can be disengaged from the container so as to be used as a sunshield for a pair of eyeglasses.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
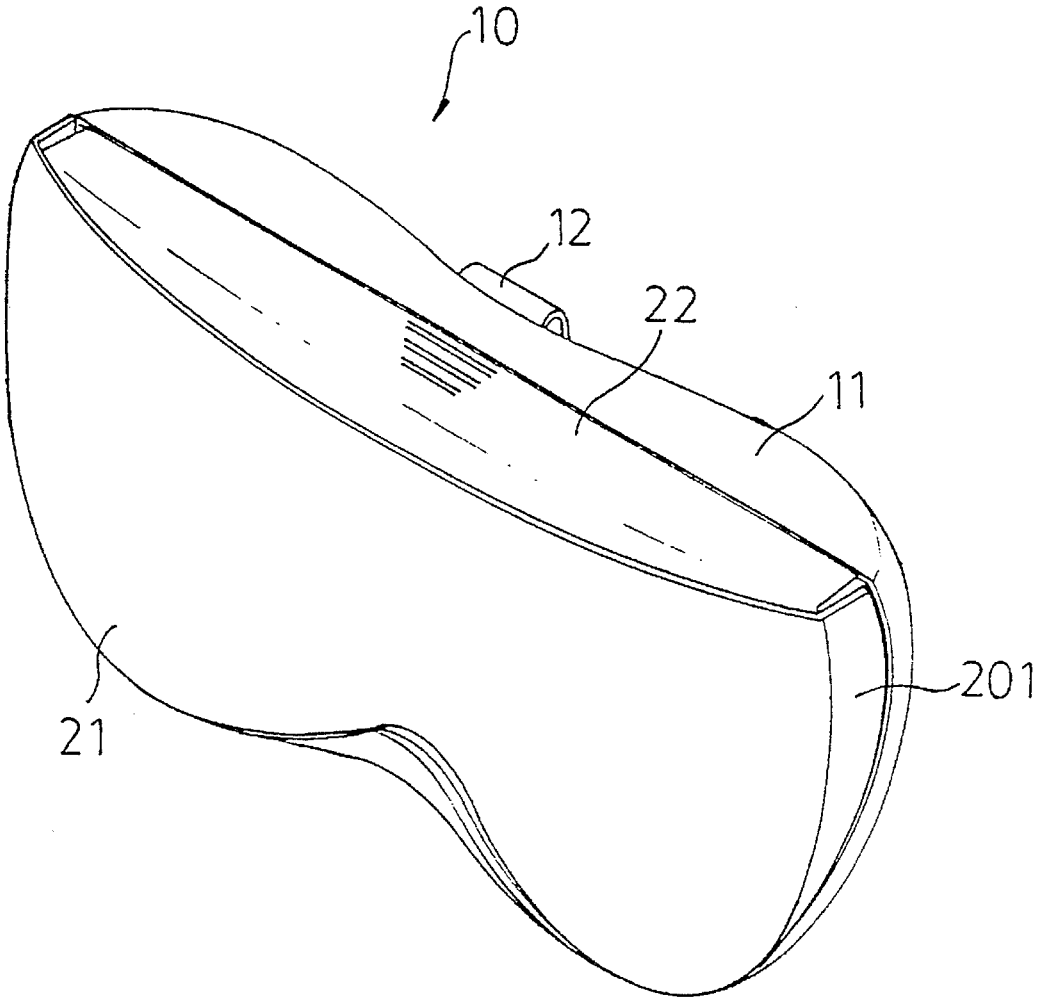
FIG. 1 is a perspective view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
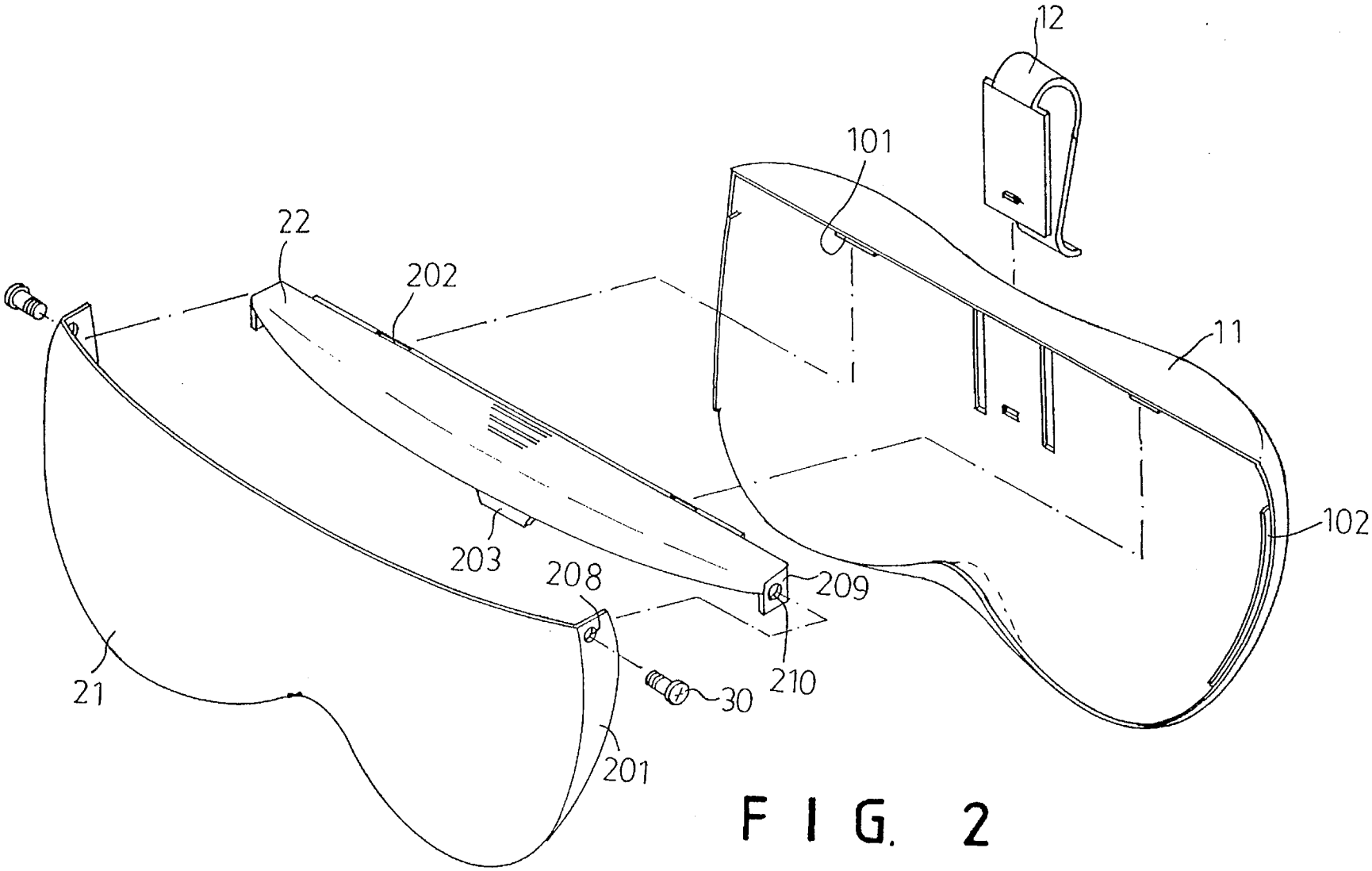
FIG. 2 is an exploded view of the present invention.

With reference to the drawings and in particular to FIGS. 1 and 2 thereof, the eyeglasses case according to the present invention mainly comprises a cover 21, a movable frame 22, a container 11, and a clip 12.

The cover 21 is made of transparent colored plastic or the like and has a shape of a pair of eyeglasses. Both sides of the cover 21 is formed with a lug 201 having a hole 208 close to its upper end. The movable frame 22 is provided at both ends with an ear 209 having an opening 210. The movable frame 22 is rotatably fitted between the two lugs 210 of the cover 21 by two screws 30 extending through the holes 208 of the cover 21 and the openings 210 of the movable frame 22. The bottom of the movable frame 22 is formed with a recess 205 (see FIG. 3) with two opposite side walls 203 (see FIG. 3). In addition, the top of the movable frame 22 has two slits 202. The container 11 is used for receiving a pair of eyeglasses and has two opposite side edges 102 adapted to engage with the lugs 201 of the cover 21 and two opposite upper edges 101 adapted to engage with the slits 202 of the movable frame 22.

The clip 12 is mounted on the rear side of the container 11 so that the container 11 can be conveniently engaged with a belt (not shown).

Figure 3:
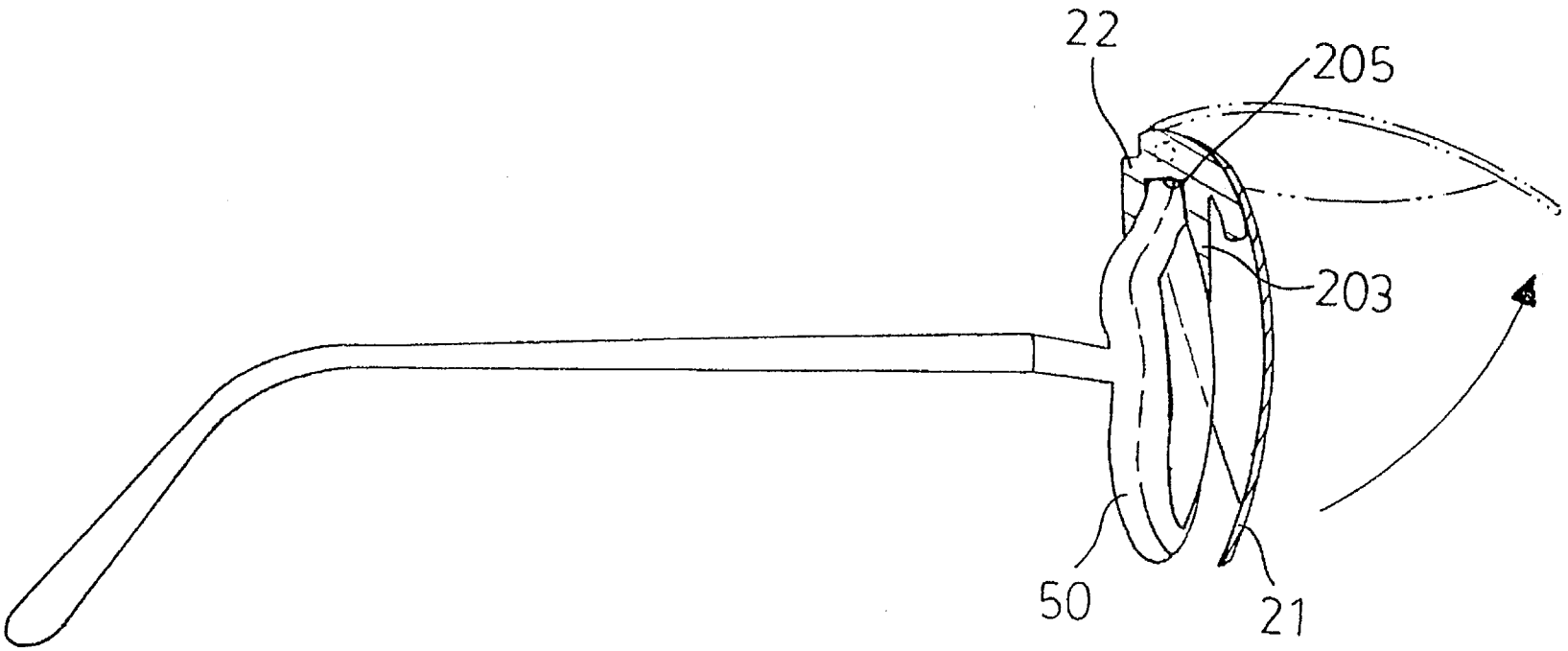
FIG. 3 is a working view of the present invention.

When desired to use the cover 21 as a sunshield for a pair of eyeglasses, first detach the movable frame 22 together with the cover 21 from the container 11 and then engage the upper portion of the eyeglasses with the recess 205 of the movable frame 22 (see FIG. 3). Since the cover 21 is rotatably connected with movable frame 22, then the cover 21 can be moved up with respect to the eyeglasses as shown in FIG. 3.

When not in use, it is only necessary to detach the movable frame 22 together with the cover 21 from the container 11 and then engage the slits 202 of the movable frame with the upper edges 101 of the container 11.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. An eyeglasses case comprising:

a cover made of transparent colored material and having two lugs each at one side thereof;

a movable frame having two ears each at one end thereof and being rotatably connected between the two lugs of said cover, said movable frame having a bottom formed with a recess with two opposite side walls and having a top formed with two slits; and a container having two side edges adapted to engage with the lugs of said cover and two upper edges adapted to engage with the slits of said movable frame.

2. The eyeglasses case as claimed in claim 1, further comprising a clip mounted on a rear side of said container.

* * * * *